US008568093B2

(12) United States Patent
Grønborg

(10) Patent No.: US 8,568,093 B2
(45) Date of Patent: Oct. 29, 2013

(54) MULTI-STAGE CENTRIFUGAL PUMP ASSEMBLY (BEARING CARRIER)

(75) Inventor: Esben Brun Grønborg, Ålborg (DK)

(73) Assignee: Grundfos Management a/s, Bjerringbro (DK)

( * ) Notice: Subject to any disclaimer, the term of this patent is extended or adjusted under 35 U.S.C. 154(b) by 903 days.

(21) Appl. No.: 12/720,860

(22) Filed: Mar. 10, 2010

(65) Prior Publication Data

US 2010/0232951 A1 Sep. 16, 2010

(30) Foreign Application Priority Data

Mar. 10, 2009 (EP) ..... 09003452

(51) Int. Cl.
*F04D 29/42* (2006.01)

(52) U.S. Cl.
USPC ..... 415/206; 415/213.1; 415/214.1; 415/200; 415/912

(58) Field of Classification Search
USPC ..... 415/213.1, 214.1, 200, 206, 912
See application file for complete search history.

(56) References Cited

U.S. PATENT DOCUMENTS

| | | | | |
|---|---|---|---|---|
| 3,115,843 | A * | 12/1963 | Hornschuch | 417/360 |
| 3,289,923 | A * | 12/1966 | Millman | 415/199.3 |
| 3,526,469 | A | 9/1970 | Lipe et al. | |
| 3,607,675 | A | 9/1971 | Haines | |
| 4,775,295 | A * | 10/1988 | Starke et al. | 415/182.1 |
| 5,318,403 | A * | 6/1994 | Kajiwara et al. | 415/214.1 |
| 5,638,796 | A | 6/1997 | Adams, III et al. | |
| 6,082,960 | A | 7/2000 | Fandrey et al. | |
| 6,203,294 | B1 | 3/2001 | Turley et al. | |
| 6,872,051 | B2 * | 3/2005 | Miyazaki et al. | 415/213.1 |

FOREIGN PATENT DOCUMENTS

| | | | |
|---|---|---|---|
| CN | 86100758 | A | 8/1987 |
| CN | 2616721 | Y | 5/2004 |
| CN | 2795503 | Y | 7/2006 |
| CN | 2816435 | Y | 9/2006 |
| CN | 1989347 | A | 6/2007 |
| DE | 2011536 | A1 | 10/1970 |
| DE | 29513904 | U1 | 2/1997 |
| EP | 1178212 | A2 | 2/2002 |
| EP | 1650440 | A1 | 4/2006 |
| GB | 907084 | A | 10/1962 |
| WO | 2006/008843 | A1 | 1/2006 |
| WO | 2006/008844 | A1 | 1/2006 |

OTHER PUBLICATIONS

Office Action issued Sep. 5, 2012 in CN Application No. 201010135622.7.

Office Action issued Nov. 11, 2011 in EP Application No. 09003452.1.

Office Action issued Mar. 4, 2013 in CN Application No. 201010135622.7.

* cited by examiner

*Primary Examiner* — Ninh H Nguyen

(74) *Attorney, Agent, or Firm* — Panitch Schwarze Belisario & Nadel LLP

(57) ABSTRACT

A multi-stage centrifugal pump assembly which is manufactured in the same construction type with cast components on the one hand, and with a stainless steel lining formed of sheet metal on the other hand, includes a bearing carrier (13) which is designed and suitable for the connection of a cast housing component (12) as well as for receiving a sheet metal lining made of stainless steel.

13 Claims, 5 Drawing Sheets

MULTI-STAGE CENTRIFUGAL PUMP ASSEMBLY (BEARING CARRIER)

BACKGROUND OF THE INVENTION

The invention relates to a multi-stage centrifugal pump assembly having a motor housing and a pump housing connected thereto and having a bearing carrier which receives a bearing of a shaft, which on the motor side carries a rotor and on the pump side carries impellers arranged in pump chambers.

With regard to the multi-stage centrifugal pump assemblies being discussed here, it is particularly the case of those with a lying shaft, thus with which the motor and the pump are arranged next to one another on operation. Such assemblies, for some time, have been counted as belonging to the state of the art, and are manufactured and offered for example by the company Grundfos under the model range descriptions CH and CHN. They consist of an electric drive motor and of a single-stage or multi-stage centrifugal pump which is connected thereto, wherein the motor housing of the motor is connected to the pump housing, and a bearing carrier is provided between the pump housing and the motor housing, said bearing carrier receiving a bearing of a shaft, which on the motor-side carries a rotor and on the pump-side carries impellers, which are arranged in pump chambers. This bearing carrier either forms a part of the motor housing or a part of the pump housing or both.

The above mentioned model ranges CH and CHN differ essentially by the fact that with the model range CH, the end-side pump housing parts are manufactured from a cast, whereas with the model range CHN, all fluid leading parts of the pump are lined with stainless steel or consist of stainless steel. Apart from the drive motors, the two model ranges comprise a multitude of the same parts, thus typically the impellers, as well as the pump chambers, which consist of sheet metal and which encompass the diffuser of the respective stage, but also a multitude of different components.

BRIEF SUMMARY OF THE INVENTION

Against this background, it is the object of the invention to design a multi-stage centrifugal pump assembly of the known type, which is typically manufactured in two construction type variants, such that it may be manufactured more economically.

According to the invention, this object is achieved by a centrifugal pump assembly of the type described at the outset, wherein the bearing carrier is designed for selectively receiving a cast housing part comprising the pressure connection of the pump or of a lining part formed of sheet metal.

The multi-stage centrifugal pump assembly according to the invention comprises a motor housing and a pump housing connected thereto, and a bearing carrier which may form part of the motor housing, part of the pump housing or a part of both housings, and which receives a bearing of a shaft, which on the motor side caries a rotor, and on the pump side carriers impellers which are arranged in pump chambers. According to the invention, the bearing carrier is for selectively receiving a cast housing part comprising the pressure connection of the pump, or a lining part formed of sheet metal, thus a component for lining.

The basic concept of the present invention is to increase the number of equal parts of both pump model ranges, in order to save manufacturing costs. Thereby, according to the invention, the component which forms the bearing carrier and which is comparatively complicated to manufacture, is designed such that it may selectively receive a cast housing component which connects thereto and which comprises the pressure connection of the pump, or a lining part formed of sheet metal, thus may be applied to the same extent for both model ranges. Due to the fact that according to the invention, both model ranges may be manufactured with the same bearing carrier, the variety of parts is reduced, by which means the manufacturing costs, storage costs and likewise may be reduced.

Advantageously, the bearing carrier according to an embodiment of the invention on the pump side comprises a first support ring, which is designed and arranged corresponding to the support region, in particular the outer diameter of the pump chambers. This support region is in particular provided for the variant lined with stainless steel, which in this region, specifically the region of the outer diameter of the pump chambers, requires a counter-bearing, in order to be able to press these onto one another in a sealed and firm manner.

Advantageously, the bearing carrier on the pump side comprises a second support ring, which lies within the first support ring and which supports the lining part on the inside. The lining part, which typically consists of comparatively thin stainless steel sheet, requires a further support in this region, since typically the pressure of the last pump stage prevails in this region, which may lead to comparatively high pressure forces. It is therefore useful to suitably support the lining for avoiding correspondingly high sheet metal thicknesses.

Preferably, the first or second support ring are not only designed for the support, but also as a centering ring for the lining part or the cast part, and ensure that the previously mentioned components are arranged at their correct position with regard to the common rotation axis of the motor and pump.

According to an advantageous further embodiment of the invention, the bearing carrier is provided with a third support ring on the pump side, which is arranged within the first and the second support ring and which axially supports the stationary part of an axial face seal. This design in particular, is advantageous for the model range lined with stainless steel sheet metal, with which such a support formed from sheet metal would entail some effort with regard to its construction.

Advantageously, a groove which is open to the pump is provided in the bearing carrier outside the first support ring, and this groove serves for the positive-fit receiving of centering means integrally formed in the cast part, or a seal which seals the lining part with respect to at least one housing casing, said centering means engaging into the groove with its ends. This groove in the bearing carrier, and which is open towards the pump, thus has different functions depending on the connection component. With the connection of the cast part, this groove serves for receiving the centering means formed on the cast part, in particular a centering ring, whereas with the construction design lined with stainless steel sheet, this groove serves at least also for arranging a seal, which seals the lining part at least with respect to the housing casing, as the case may be, yet also with respect to the bearing carrier itself. Thereby, the lining part and the housing casing advantageously engage into the groove amid the enclosure of the seal.

It is particularly favorable if, according to a further embodiment of the invention, the lining part is formed to shape at its radially outer end, for forming a space receiving a part of the sealing ring, in particular for forming a groove, in which the seal, typically an O-ring lies. This design in particular also has advantages with regard to assembly technology, since the seal may be arranged in a freely accessible manner in the radially outwardly open groove of the lining part, whereupon the insertion into the groove open to the pump, in the bearing carrier is effected, in which bearing carrier the seal is practically no longer accessible.

The housing casing, which is typically formed of stainless steel sheet, at the side distant to the motor, is closed by an end-side lining. This formation of the housing casing and the end-side lining is advantageously designed in a pot-like manner, wherein the lining forms the pot base. Such a component is particularly usefully designed as one piece, preferably as a deep-drawn sheet metal part, which is inexpensive to manufacture in large scale manufacture. The single piece design of this component is also particularly advantageous with regard to the assembly and the degree of sealing.

According to an advantageous further embodiment of the invention, the end-side lining is supported by an end-side support body which consists of a cast for example. Such a support body permits the lining itself to only have to accommodate very limited forces, and thus may be manufactured inexpensively of comparatively thin sheet metal. Since the support body is not to come into contact with the delivery medium, according to the invention, one envisages providing a suction union of stainless steel in the end-side lining, preferably in a centric manner, through which suction union the support body is led. Such a suction union may either be formed of sheet metal or may be formed by a separate annular component consisting of stainless steel, which is connected in a sealed and fixed manner to the remaining part of the lining by welding.

Advantageously, the housing casing is arranged with a spacing from the pump chambers and comprises the pressure connection of the pump. Then, the last pump stage is connected in a fluid-leading manner to the inside of the housing casing, on which the pressure connection of the pump, typically designed as a pressure union, is arranged.

In order to integrate the individual pump stages with the surrounding casing in a firm manner between the bearing carrier and the end-side support body, according to the invention, tension means are provided, which amid the integration of the pump chambers and the housing casing, connect the end-side support body to the bearing carrier. Such tension means are typically screws, for example stretching screws, between which the previously mentioned components are clamped.

According to an embodiment of the invention, the end-side support body is provided with an outer support ring, which is designed and arranged in accordance with the support region, in particular the outer diameter of the pump chambers, as well as furthermore with at least one inner support ring and/or an inner support surface, which supports the lining in the region around the suction union. All this is to ensure a secure support of the pump chambers with the variant which is lined with sheet metal. Further support surfaces may be provided as the case may be.

Although it is useful to clamp the pump chambers between the support body and the bearing carrier, with such sheet metal designs, as are formed by the pump chambers and the surrounding casing, one must however take care that the pressing forces only act where they are supposed to act, and do not lead to deformations of the sheet metal components. According to a further design of the invention, one therefore envisages the end-side support body in the region aligned with the housing casing being formed with free space to this or the end-side lining. This free space ensures that no clamping forces are applied onto the housing casing, but only onto the pump chambers.

For the non-lined variant, according to a further embodiment of the invention, one envisages the pump chambers being clamped by tension means between an end-side cast part which comprises the suction connection of the pump, and the cast housing part, wherein the cast housing part is fastened on the bearing carrier, preferably by screws.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
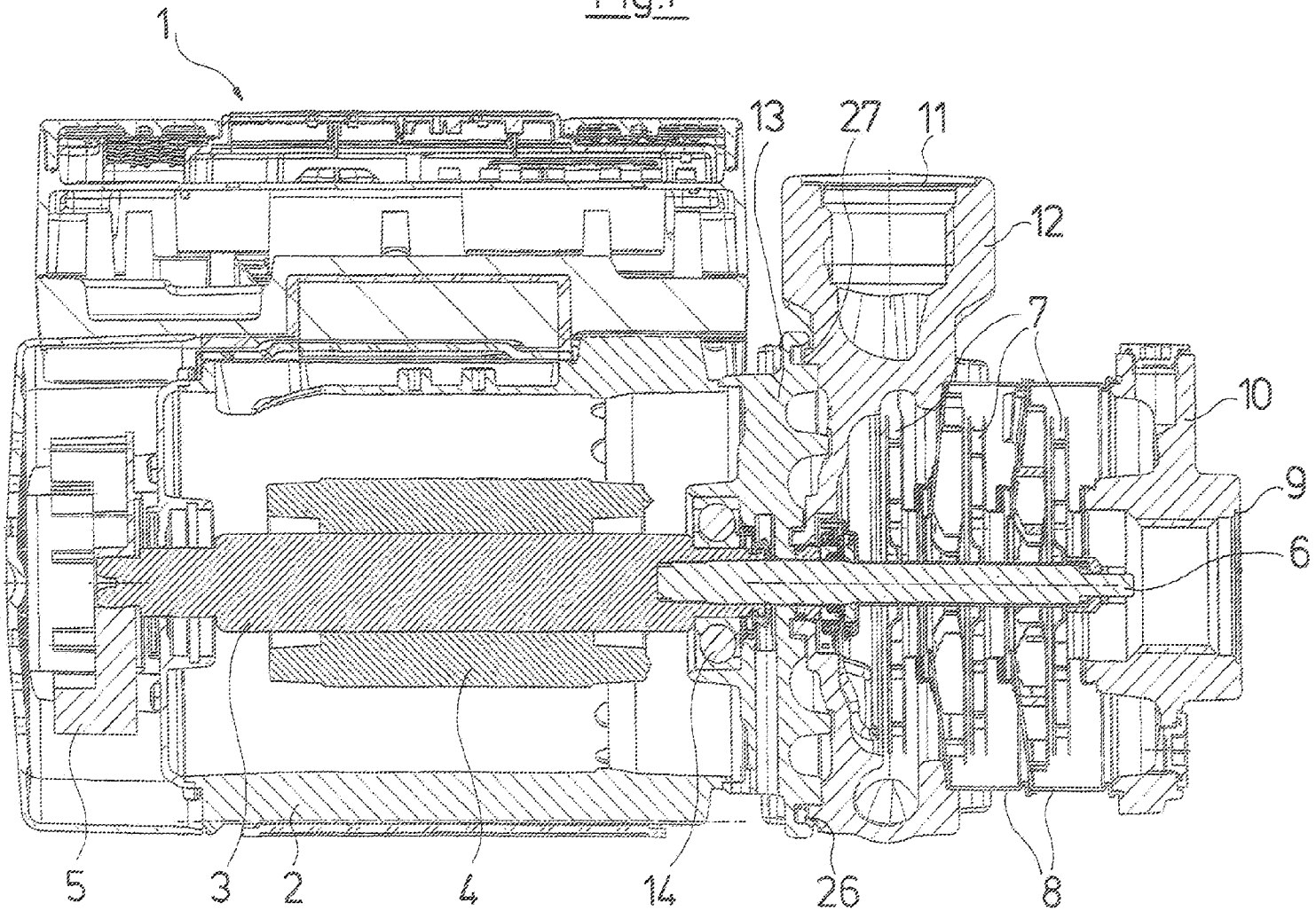
FIG. 1 is a greatly simplified schematic representation in longitudinal section of a three-stage centrifugal pump assembly of a first model range.
Figure 3:
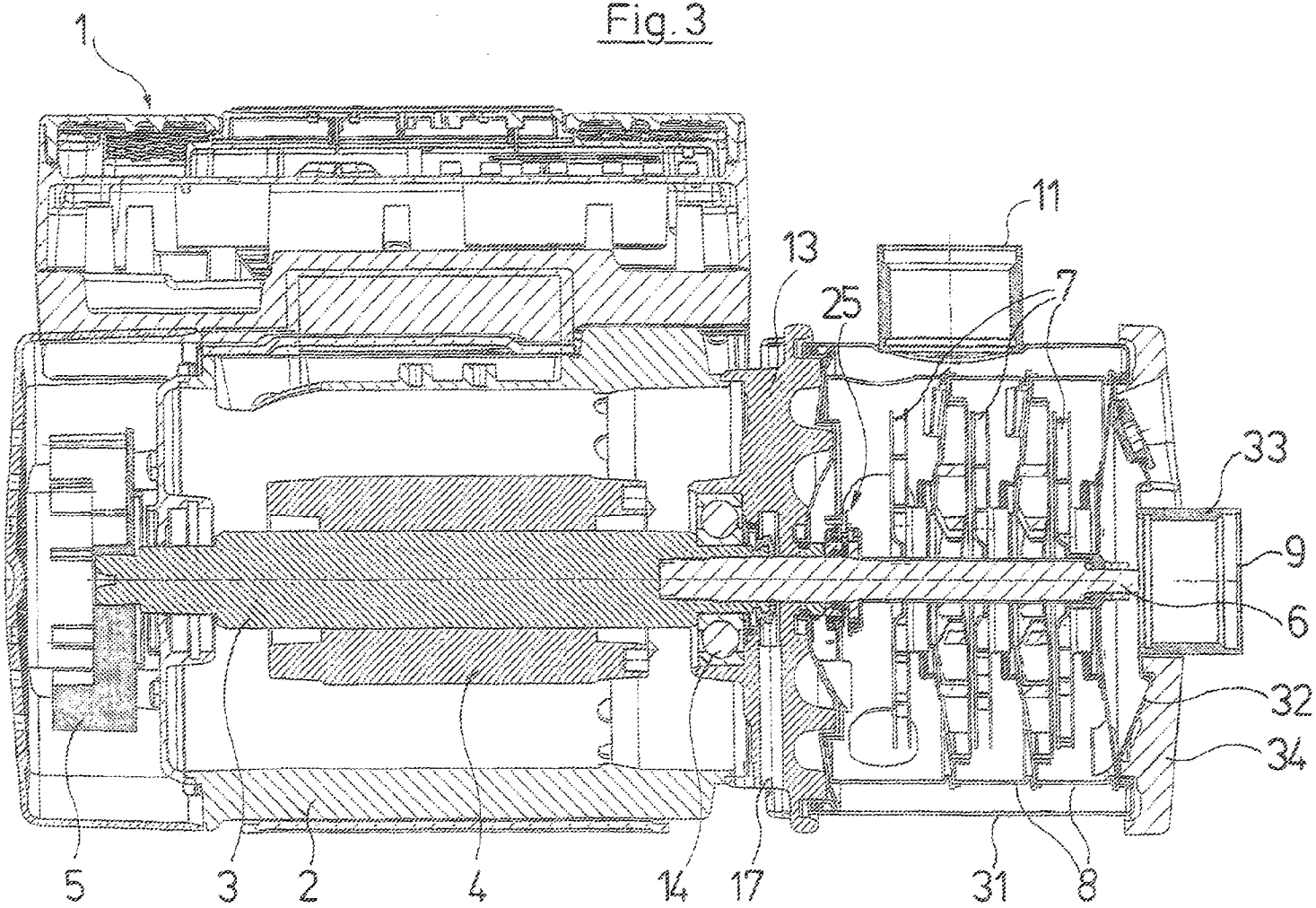
FIG. 3 is a longitudinal section of a three-stage centrifugal pump assembly of the model range of the representation according to FIG. 1, lined with stainless steel sheet.

The three-stage centrifugal pump assembly which is represented by FIGS. 1 and 3, in each case comprise a motor 1 with a motor housing 2, in which a motor shaft 3 is arranged, which carriers a rotor 4 and carries a fan wheel 5 at one end (the left one in the Figs.), and at the other end is connected in a rotationally fixed manner to a pump shaft 6, which carries three pump impellers 7, which in each case run in pump chambers 8, and which, in a manner known per se, are arranged fluidically in series, as is normal with multi-stage pumps.

Figure 2:
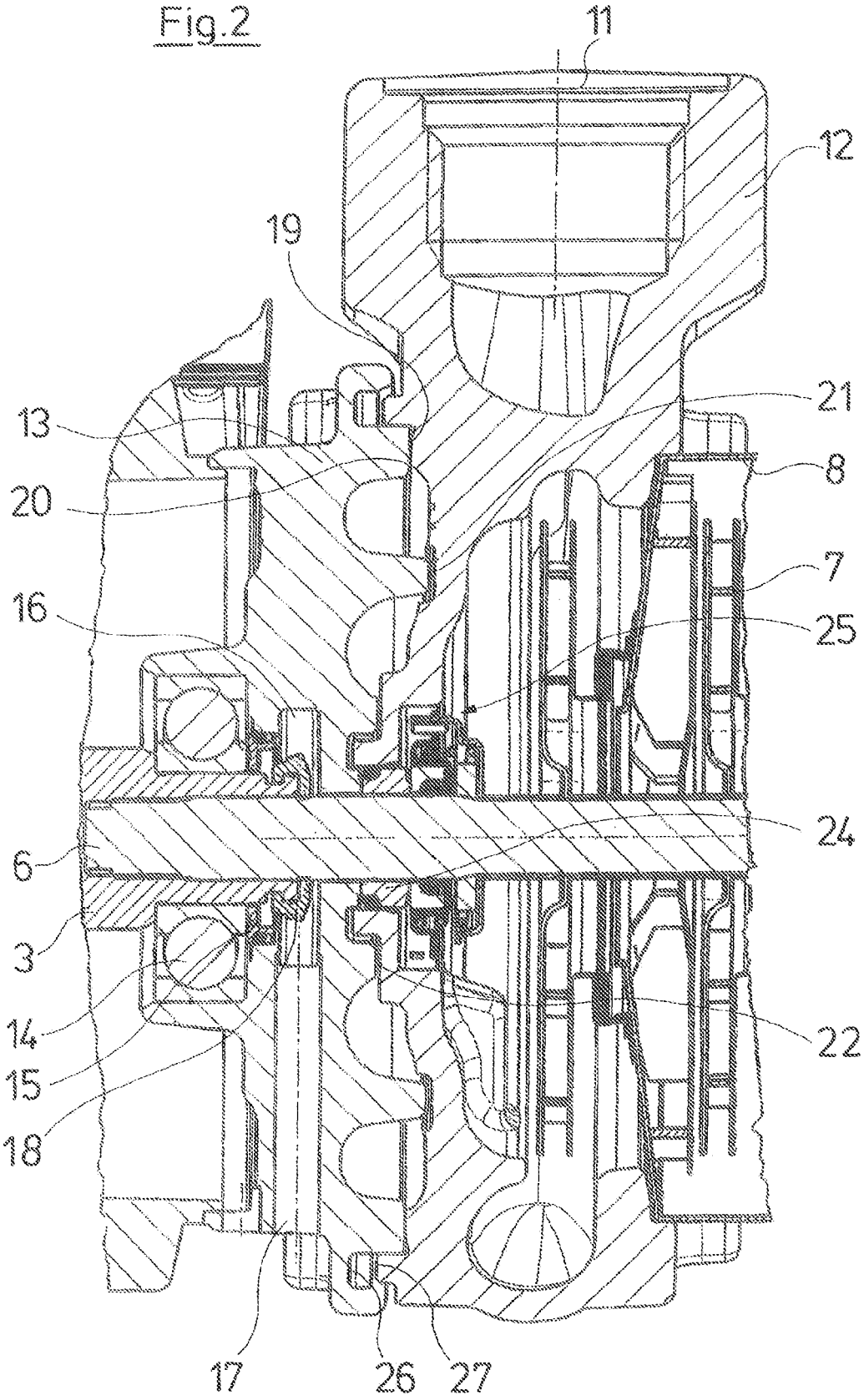
FIG. 2 is an enlarged representation of the detail of the representation according to FIG. 1, which shows the bearing carrier.

With the embodiment according to FIGS. 1 and 2, the pump chambers 8 are incorporated between an end-side cast part 10 comprising a suction connection 9, and a cast housing part 12 comprising the pressure connection 11 of the pump. The pump chambers 8 are integrated between these components 10 and 12 by clamping screws which are not represented in the drawings. The cast housing part 12 is fastened on the bearing carrier 13 by screws, and the bearing carrier in turn is firmly screwed to the motor housing 2.

The bearing carrier 13 at its side which faces the motor 1, carries a ball bearing 14, as is particularly shown in FIG. 2, with which the pump-side end of the motor shaft 3 is rotatably mounted, said end in this region being connected in a rotationally fixed manner to the pump shaft 6, which is seated in a pocket hole in the pump-side end of the motor shaft 3. The bearing carrier 13 carries a stationary sealing ring 15, which is radially sealed with respect to the bearing carrier 13 by an O-ring, and which with its end-side facing the motor sealingly bears on the rotating axial side of the inner ring of the ball bearing 14, which is seated on the motor shaft 3. The sealing ring 15 is arranged in a free space 16 of the bearing carrier 13, which is connected via a channel 17 to the outer surroundings surrounding the motor and the pump. A rotating slinger ring 18 is arranged in this free space 16 and with its inner side seals with respect to the pump shaft 6 and there keeps any fluid exiting along the shaft 6, away from the motor 1.

On the side which is directed to the pump, the bearing carrier 13 comprises a first outer support ring 19 which is arranged roughly flush to the outer diameter of the pump chambers 8 and with the construction variant according to the FIGS. 1 and 2, bears on a corresponding support surface 20 of the cast housing part 12.

The bearing carrier 13 comprises a second support ring 21, which is arranged concentrically to the first support ring and projects axially towards the pump. With this embodiment variant according to FIGS. 1 and 2, this second support ring 21 has no function and is distanced to the cast housing part 12. A further support ring 22 is arranged concentrically within the second support ring 21 on the bearing carrier 13 and is arranged in a returning manner with respect to the first and second support ring, and bears on a corresponding counter-surface of the cast housing part 12. A third support ring 23 is arranged within the previously mentioned support rings 19, 21 and 22 and surrounds the pump shaft 6. This third support ring 23 serves for the axial support of a stationary ring 24 of an axial face seal 25. This stationary ring 24 is radially sealed with respect to the respective inner side of the cast housing part 12 by an O-ring.

Moreover, the bearing carrier 13 close to its outer periphery comprises a peripheral groove 26, into which a centering ring 27 engages with its radial inner surface and which is integrally formed on the cast housing part 12 on the side which faces the motor.

Figure 4:
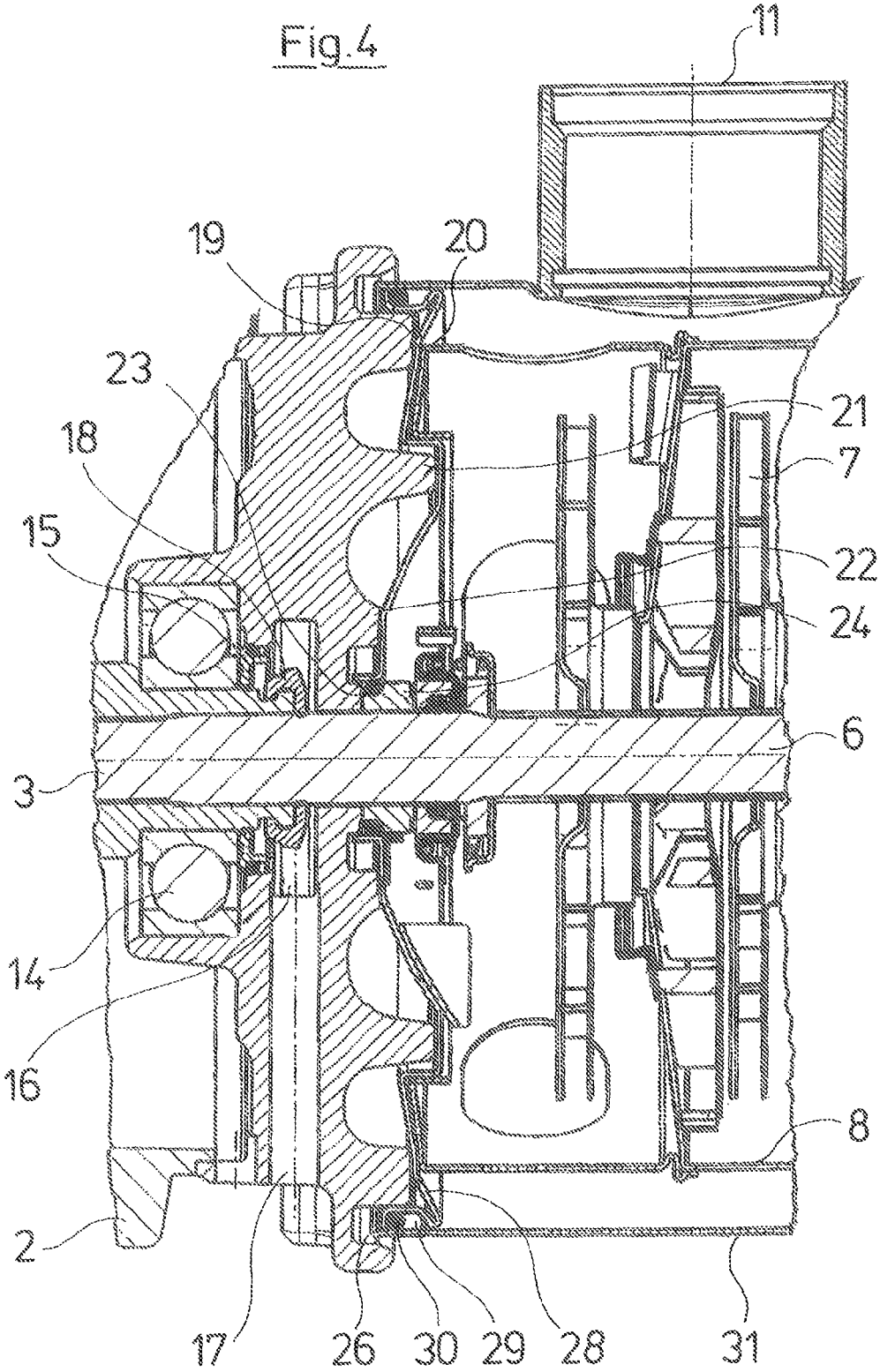
FIG. 4 is an enlarged representation of the detail of FIG. 3, showing the bearing carrier.
Figure 5:
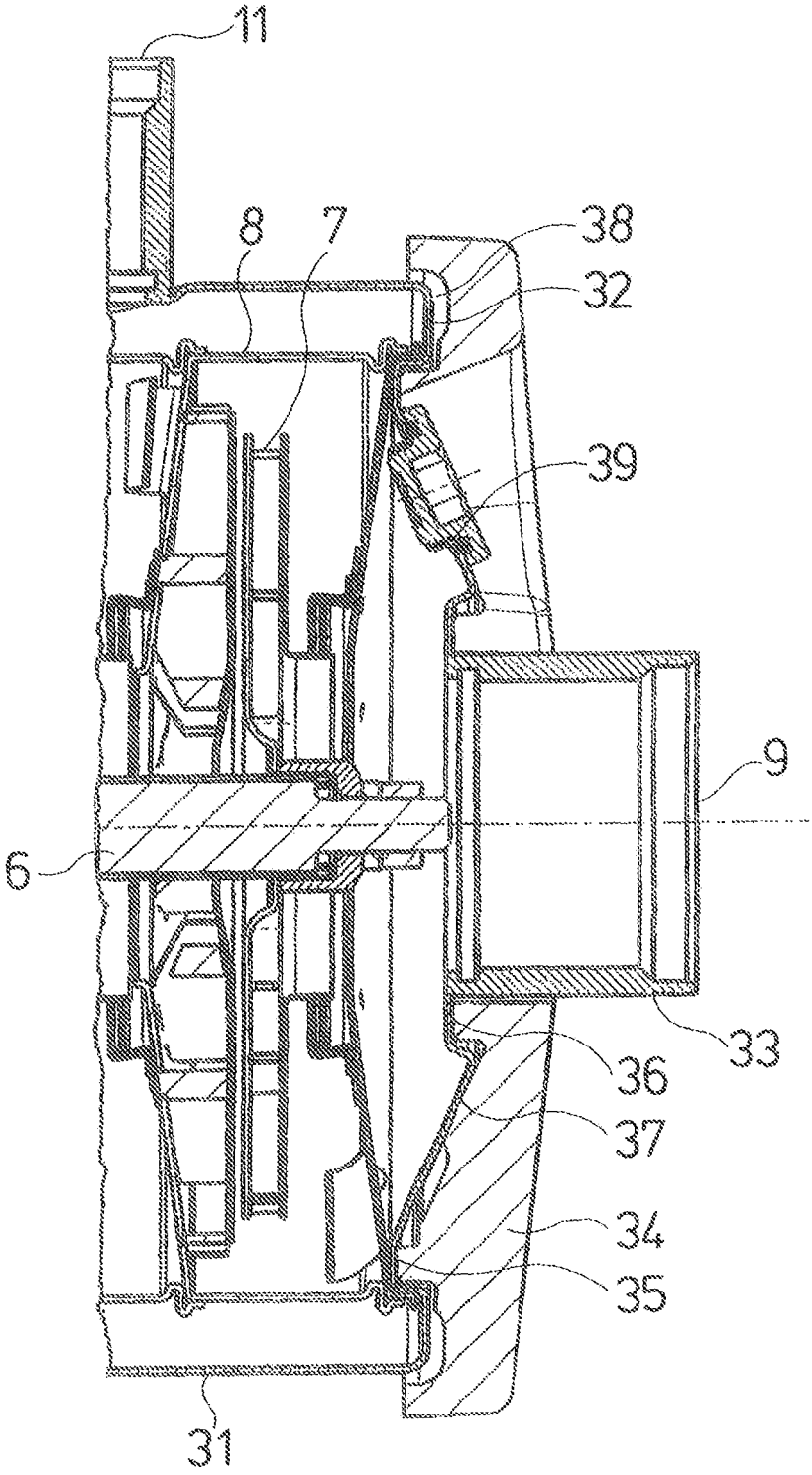
FIG. 5 is in an enlarged representation of the detail of FIG. 3, showing the end-side support body.

With the embodiment variant represented by FIGS. 3 to 5, the motor 1 and the bearing carrier 13 as well as the components integrated therein towards the motor, are designed in an identical manner as previously described, and for this reason are also provided with the same reference numerals. The pump is likewise of three stages and is functionally identical to the previously described one, but however differs from this by the fact that all fluid-leading components, inasmuch as they do not consist of stainless steel as with the impellers 7 and pump chambers 8, are lined with stainless steel sheet metal. With this construction design, a lining part 28 in the form of a profiled sheet metal disk connects to the bearing carrier 13 on the pump side. The lining part 28 comprises an inner, axially extending ring section, with which it bears on the outer periphery of the third support ring 23, but extends axially further on the pump side and there accommodates the stationary ring 24 of the axial face seal 25, which is supported axially on the third support ring 23 and which is sealed by an O-ring with respect to this annular section of the lining part 28. The lining part 28 then extends radially outwards from the outer periphery of the stationary ring 24, and there it bears on the further support ring 22. From there, it extends further radially outwards and is simultaneously bent towards the pump in the axial direction, in order then to be supported on the second support ring 21. The lining part 28 extends radially beyond the second support ring 21 and then returns back at a distance to this towards the motor, in order, in the region of the first outer support ring 19, to come to bear where the outer sides of the pump chambers 8 come to bear. From there, the lining part 28 is directed radially outwards and towards the pump, and then bent by about 180° and formed into shape into a groove 29 which runs radially on the outer periphery and is open to the outside. An O-ring 30 is arranged within this groove 29 and projects radially to the outside and there is sealed with respect to a motor-side end of a housing casing 31, which together with the section of the lining part 28, which is formed into shape in a groove-like manner, is incorporated in the groove 26 of the bearing carrier 13. As is particularly shown in FIG. 4, the forming to shape of the lining part 28 is designed such that the O-ring 30 is largely encapsulated with respect to the pressure space which is formed by the housing casing 31 and the outer side of the pump chambers 8. The outer periphery of the outer support ring 19 at the same time forms a centering ring for the lining part 28.

The housing casing 31 surrounds the pump chambers 8 at a distance, and is connected to the pressure side of the third pump chamber 8 adjacent to the motor 1. The pressure connection 11 of the pump, which here is designed as a pressure union, is led out of the housing casing 31. The housing casing 31 has an essentially cylindrical shape and at its pump-side end which is distant to the motor 1, is connected to an end-side lining 32, which comprises a central recess, in which a union 33 is incorporated, said union forming the suction connection 9 of the pump.

The union 33 is formed of stainless steel and is connected to the lining 32 in a sealed and firm manner by welding. The end-side lining 32 and the housing casing 31 are designed in a pot-like manner and are manufactured by deep-drawing. Mechanically, the sheet metal design, in particular the end-side lining 32, is supported by an end-side support body 34, which is connected to the bearing carrier 13 via tension rods which are not shown, and consists of a cast. The union 33 passes centrally through the support body 34, and this support body further has an outer support ring 35, which is arranged correspondingly to the support region, thus to the outer diameter of the pump chambers 8, as well as an inner support ring 36 which surrounds the union 33 on its inner side. Moreover, a support surface 37, which is directed to the outer support ring 35 and which returns back with respect to the inner support ring 36 and on which the end-side lining 32 bears, is provided between the inner support ring 36 and the outer support ring 35. The end-side support body 34 supports the end-side lining 32 in the region of the free end-faces as well as in particular in the region, in which the pump chambers 8 bear. The radial outer side of the outer support ring 35 moreover serves for centering for the end-side lining 32.

The support surface 37 is interrupted by a filling opening 39, which may be closed in a tight manner by a closure plug. This filling opening 39 not only passes through the end-side lining 32 but, roughly flush to this, a suitably widened recess is also provided in the end-side support body 34, in order to ensure the accessibility of the opening. This opening 39 serves for filling the pump with fluid before starting operation.

The end-side support body 34 extends radially beyond the housing casing 31, where also the tension rods (not shown) are arranged. A peripheral free space 38 is provided in the region of the housing casing 31 as well as beyond this directed radially inwardly up to the outer periphery of the pump chambers 8, and this free space ensures that no forces are exerted on the housing casing 31 in this region.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A multi-stage centrifugal pump assembly comprising a motor housing (2), a pump housing connected thereto, and a bearing carrier (13) receiving a bearing (14) of a shaft (3), which on a motor side carries a rotor (4) and on a pump side carries impellers (7) arranged in pump chambers (8), wherein the bearing carrier (13) is designed for selectively receiving a cast housing part (12) comprising a pressure connection (11) of the pump or of a lining part (28) formed of sheet metal, wherein the bearing carrier (13) on the pump side comprises a first support ring (19), which is designed and arranged corresponding to a support region to an outer diameter of the pump chambers (8), wherein the bearing carrier (13) on the pump side comprises a second support ring (21) which lies within the first support ring (19) and which supports the lining part (28) on the inside, and wherein the bearing carrier (13) on the pump side comprises a third support ring (23) arranged within the first and the second support rings (19, 21) and which axially supports a stationary part (24) of an axial face seal (15).

2. The multi-stage centrifugal pump assembly according to claim 1, wherein the first or the second support ring (19, 21) is designed as a centering ring for the lining part (28) or the cast part (12).

3. A multi-stage centrifugal pump assembly comprising a motor housing (2), a pump housing connected thereto, and a bearing carrier (13) receiving a bearing (14) of a shaft (3), which on a motor side carries a rotor (4) and on a pump side carries impellers (7) arranged in pump chambers (8), wherein the bearing carrier (13) is designed for selectively receiving a cast housing part (12) comprising a pressure connection (11) of the pump or of a lining part (28) formed of sheet metal, wherein the bearing carrier (13) on the pump side comprises a first support ring (19), which is designed and arranged corresponding to a support region to an outer diameter of the pump chambers (8), and wherein a groove (26) open to the pump is provided in the bearing carrier (13), outside the first support ring (19), the groove serving for positive-fit receiving of centering means (27) integrally formed in the cast housing part (12) or of a seal (30) which seals the lining part (28) with respect to at least one housing casing (31), the centering means having ends thereof engaging into the groove (26).

4. The multi-stage centrifugal pump assembly according to claim 3, wherein the lining part (28) at its radially outer end is formed to shape for forming a space receiving a part of the seal (30) for forming a groove (29).

5. The multi-stage centrifugal pump assembly according to claim 3, wherein the housing casing (31) is closed at a side which is distant to the motor (1) by an end-side lining (32).

6. The multi-stage centrifugal pump assembly according to claim 5, wherein the housing casing (31) and the end-side lining (32) are designed in a pot-like manner and as one piece as a deep-drawn sheet metal part.

7. The multi-stage centrifugal pump assembly according to claim 5, wherein the end-side lining (32) is supported by an end-side support body (34).

8. The multi-stage centrifugal pump assembly according to claim 7, wherein the end side lining (32) comprises a suction union (33) which is led through the support body (34).

9. The multi-stage centrifugal pump assembly according to claim 7, wherein tension means are provided, which connect the end-side support body (34) to the bearing carrier (13) amid incorporation of the pump chambers (8) and the housing casing (31).

10. The multi-stage centrifugal pump assembly according to claim 7, wherein the end-side support body (34) comprises an outer support ring (35), which is designed and arranged corresponding to a support region to the outer diameter of the pump chambers (8), as well as at least one inner support ring (36) and/or an inner support surface (37).

11. The multi-stage centrifugal pump assembly according to claim 7, wherein the end-side support body (34) in a region aligned with the housing casing (31) is formed with free space (38) to the housing casing (31) or to the end-side lining (32).

12. The multi-stage centrifugal pump assembly according to claim 3, wherein the housing casing (31) is arranged at a distance from the pump chambers (8) and comprises the pressure connection (11) of the pump.

13. A multi-stage centrifugal pump assembly comprising a motor housing (2), a pump housing connected thereto, and a bearing carrier (13) receiving a bearing (14) of a shaft (3), which on a motor side carries a rotor (4) and on a pump side carries impellers (7) arranged in pump chambers (8), wherein the bearing carrier (13) is designed for selectively receiving a cast housing part (12) comprising a pressure connection (11) of the pump or of a lining part (28) formed of sheet metal, wherein the pump chambers (8) are clamped by tension means between an end-side cast part (10), which comprises a suction connection (9) of the pump, and the cast housing part (12), wherein the cast housing part (12) is fastened in the bearing carrier (13) by a screw.

* * * * *